US008631998B1

(12) United States Patent
Connelly et al.

(10) Patent No.: US 8,631,998 B1
(45) Date of Patent: Jan. 21, 2014

(54) SOLAR POWERED ILLUMINATED MAILBOX POST

(75) Inventors: Rowan Connelly, Fort Myers, FL (US); Tara Lee Golub, Cape Coral, FL (US); Kevin James Maley, Belcarra (CA)

(73) Assignee: Brightlight Solutions, LLC, Cape Coral, FL (US)

( * ) Notice: Subject to any disclaimer, the term of this patent is extended or adjusted under 35 U.S.C. 154(b) by 0 days.

(21) Appl. No.: 11/981,100

(22) Filed: Oct. 31, 2007

(51) Int. Cl.
*A47G 29/12* (2006.01)

(52) U.S. Cl.
USPC ..... 232/39; 40/566; 362/431

(58) Field of Classification Search
USPC ..... 232/39, 38; D99/32; 40/564, 566; 52/103–105; 362/154, 431; 248/146, 248/156
See application file for complete search history.

(56) References Cited

U.S. PATENT DOCUMENTS

| | | | | | |
|---|---|---|---|---|---|
| 2,260,082 | A * | 10/1941 | McCauley | 40/564 |
| 3,521,047 | A * | 7/1970 | Smith | 362/222 |
| 5,143,285 | A * | 9/1992 | Wise | 232/39 |
| D356,423 | S * | 3/1995 | Kresin | D99/32 |
| 5,564,816 | A * | 10/1996 | Arcadia et al. | 362/183 |
| D413,704 | S * | 9/1999 | Metchear, III | D99/32 |
| 6,513,284 | B1 * | 2/2003 | Sandlin | 47/66.6 |
| 6,601,968 | B2 * | 8/2003 | Voacolo | 362/154 |
| 6,739,732 | B2 * | 5/2004 | Tseng | 362/183 |
| 6,799,716 | B1 * | 10/2004 | Kuelbs | 232/39 |
| 7,216,798 | B2 * | 5/2007 | Stephens et al. | 232/39 |
| 7,293,696 | B2 * | 11/2007 | Laborde | 232/38 |
| 7,299,577 | B2 * | 11/2007 | Bisson et al. | 40/566 |
| 2004/0083634 | A1 * | 5/2004 | Blsson et al. | 40/566 |
| 2005/0132624 | A1 * | 6/2005 | Gao et al. | 40/544 |
| 2006/0104055 | A1 * | 5/2006 | Bossomo | 362/154 |
| 2007/0241922 | A1 * | 10/2007 | Brannon | 340/691.1 |

* cited by examiner

*Primary Examiner* — William Miller
(74) *Attorney, Agent, or Firm* — William E. Noonan

(57) ABSTRACT

A solar powered, illuminated mailbox post assembly includes a support post structure for supporting a mailbox operatively thereon. The support post structure includes a vertical post section for mounting in the ground and extending upwardly therefrom. The vertical post section has an interior chamber. A light unit is disposed in the chamber and includes a light source and a rechargeable power supply operatively connected to the light source for energizing the light source and causing the light source to illuminate. There is at least one solar collector operably connected to the rechargeable power supply for collecting solar energy and converting such energy to electric power that is directed to the power supply for recharging thereof. At least one window is formed in the vertical post section adjacent the chamber. The window bears indicia that are highlighted for display upon the window when the light is illuminated and light is transmitted through the window.

14 Claims, 16 Drawing Sheets

SOLAR POWERED ILLUMINATED MAILBOX POST

FIELD OF THE INVENTION

This invention relates to an illuminated mailbox post assembly and, more particularly, to a modular mailbox post equipped with a light source energized by a solar rechargeable battery.

BACKGROUND OF THE INVENTION

Various illuminated mailbox posts are known for assisting persons in locating a particular address at night or other times when visibility is restricted. Illuminating the name and/or street number on a mailbox post can be quite beneficial in a number of situations. For example, ambulance, police or other emergency personnel may require assistance in locating a particular address. A lighted mailbox post can also assist delivery persons and visitors or guests in finding their intended destination.

Wise, U.S. Pat. No. 5,143,285 and the patents referred to therein disclose conventional examples of lighted mailbox supports. These devices invariably exhibit various disadvantages. They are fairly complicated to assemble and are usually impractical to use. Wise, for example, employs what appears to be an fluorescent light bulb that is powered by an alternating current source. The bulb must be connected by electrical wiring to the power source. Installing the wiring is a time consuming, tedious and often expensive task, which may require the use of an electrician. The bulb eventually fails and must be periodically replaced. This requires that the mailbox first be painstakingly removed from the post and then replaced after a new bulb is installed. In addition, the Wise bulb is operated by a photo switch that is mounted prominently to the outside of mailbox post. Not only is the switch unattractive, it is exposed on the post and susceptible to damage. The illuminated Wise mailbox is also likely to malfunction in wet or otherwise inclement weather conditions, which can damage the wiring and, electrical connections.

The prior art does not provide for a conveniently illuminated modular mailbox post that is aesthetically attractive, easy to install and maintain, and resistant to malfunction. The need exists for a mailbox post assembly that provides such benefits and which at the same time offers improved illumination and visibility of address indicia (i.e. street numbers and/or names) carried by the mailbox post.

SUMMARY OF THE INVENTION

It is therefore an object of the present invention to provide an illuminated mailbox post assembly wherein street numbers and other address indicia are illuminated clearly, prominently and far more effectively than in known device so that the address associated with the mailbox is reliably visible at night or at other times of restricted lighting.

It is a further object of this invention to provide an illuminated mailbox post assembly featuring a modular light unit that requires infrequent light source replacement and relatively little maintenance.

It is a further object of this invention to provide an illuminated mailbox post assembly that is energized by a solar powered LED light source, which operates longer and more cost efficiently and reliably than relatively expensive and short lived fluorescent and incandescent bulbs.

It is a further object of this invention to provide an illuminated mailbox that does not require the use of an AC power source and which eliminates the expense and inconvenience associated with connecting the mailbox post to such a power source.

It is a further object of this invention to provide an illuminated mailbox post employing a modular light unit and modular display windows that may be installed and replaced in a quick and convenient manner without requiring tools or extra fasteners.

It is a further object of this invention to provide an illuminated mailbox post assembly featuring a modular construction that may be quickly and conveniently altered to provide either a side mounted or front mounted mailbox.

It is a further object of this invention to provide an aesthetically attractive illuminated mailbox post assembly that is suitable for use in all types of residences and communities and which presents a particularly advantageous mailbox option for homeowners associations that require an attractive, uniform mailbox appearance.

It is a further object of this invention to provide a highly efficient illuminated mailbox post that is lighted only at night and during periods of restricted visibility so that power consumption and maintenance costs are effectively controlled.

It is a further object of this invention to provide an illuminated mailbox post assembly featuring a compact and energy efficient light source housed protectively in the post and solar cells ideally positioned to optimally and effectively recharge and re-energize the light source such that maintenance and attendant expense are reduced considerably and a long service life is provided.

It is a further object of this invention to provide an illuminated mailbox post assembly featuring a long lasting modular light unit which is protectively enclosed within the post and resistant to damage.

It is a further object of this invention to provide an illuminated mailbox post assembly that is extremely durable and able to withstand extended outdoor use.

This invention results from a realization that a significantly improved illuminated mailbox post assembly is achieved by employing a solar rechargeable, battery powered modular LED lighting unit that is installed quickly and conveniently in the vertical post of the assembly. By using a solar rechargeable battery to power a long lasting LED light source, the unit is typically able to operate for extremely long periods of time without requiring repair or replacement. By further utilizing a unique angled reflector adjacent to the lighting unit, the LED light source, the lighting unit effectively and prominently illuminates address panels mounted on three sides of the post. This reliably and accurately displays the pertinent street number or other address information to persons attempting to locate the address associated with the mailbox post.

This invention features a solar powered, illuminated post assembly including a support post structure for supporting a mailbox operatively thereon. The support post structure includes a vertical post section for mounting in the ground and extending upwardly therefrom. The vertical post section has an interior chamber. A light unit is disposed in the chamber and includes a light source and a rechargeable power supply operatively connectible to the light source for energizing the light source and causing the light source to illuminate. There is at least one solar collector operably connected to the rechargeable power supply for collecting solar energy and converting such energy to electric power that is directed to the power supply for recharging thereof. At least one window is formed in the vertical post section adjacent the chamber. The window includes indicia that are highlighted for display upon the window when the light source is illuminated and light is transmitted through the window.

In a preferred embodiment, the support post structure further includes a horizontal post section attached to the vertical post section and extending transversely therefrom for holding a mailbox thereon. The vertical post section may have a transverse passageway formed therethrough for receiving the horizontal post section. The passageway and the horizontal post section may include substantially conforming, generally rectangular interengaging shapes. The vertical post section may have a substantially rectangular cross sectional shape, at least surrounding the interior chamber.

The horizontal post section may include a series of lower connector holes for being operatively aligned in a first pattern with a series of upper connector holes formed in the mailbox when the mailbox is oriented to extend laterally across the horizontal post section. The series of lower connector holes may be operatively aligned in a second pattern with the upper connector holes when the mailbox is oriented to extend longitudinally on the horizontal post section. This allows fastening components to be interengaged with the operatively aligned upper and lower connector holes to secure the mailbox to the horizontal post section.

The light source may include at least one and preferably two light emitting diodes (LEDs). The light unit may further include a reflector for directing light from the LED or other light source through the one or more window. The reflector may include a pair of diverging panels, each having a mirror surface from which the light source is reflected. The light unit may further include a generally vertically alignable column for supporting the reflector and generally horizontally alignable upper and lower platforms attached to and extending transversely from opposite end portions of the column. At least one of the platforms may carry a respective light source thereon.

The light unit may include a modular unit that is longitudinally and removably receivable by the chamber of the vertical post section. The chamber is preferably formed longitudinally through an upper end region of the vertical post section. A post cap may be attached to the light unit and engaged with an upper end of the vertical post section to cover the chamber when the light unit is received by the chamber. The solar collector may be mounted on the post cap. The post cap may have a plurality of inclined surfaces facing different respective directions. The solar collector may include multiple solar collection elements. Each such element may be disposed on a respective inclined surface of the post cap.

The rechargeable power supply may include a rechargeable battery for operatively connecting to the light source and a recharging circuit interconnected between the solar collector and the battery. The recharging circuit may be responsive to a predetermined electrical input from the solar collector for recharging the battery and operatively disconnecting the battery from the light source such that the light source is deactivated. Alternately, the recharging circuit may be responsive to less than the predetermined electrical input from the solar collector for operatively connecting the battery to the light source such that the battery causes the light source to illuminate.

Where the vertical post section has a rectangular cross sectional shape, the post section may be installed to extend upwardly from the ground and adjacent to a roadway with a first side of the vertical post section facing and aligned generally parallel to the roadway and two adjoining sides of the vertical post section extending laterally and generally perpendicular to the roadway. In such embodiments, the window may include three window segments, each carried by a respective one of the first side and two adjoining sides of the vertical post section. The window segment may include a first panel that carries the indicia and is disposable over a corresponding window opening in the vertical post section. A second transparent panel may be interposed over the first panel and a peripheral frame may be disposed over and surround the first and second panels. The light unit and frame may have complementary snap fastening elements for releasably securing the window segment to the vertical post section with the light unit disposed in the chamber.

DETAILED DESCRIPTION OF PREFERRED EMBODIMENTS

Other objects, features and advantages will occur from the following description of a preferred embodiment and the accompanying drawings, in which.

Figure 1:
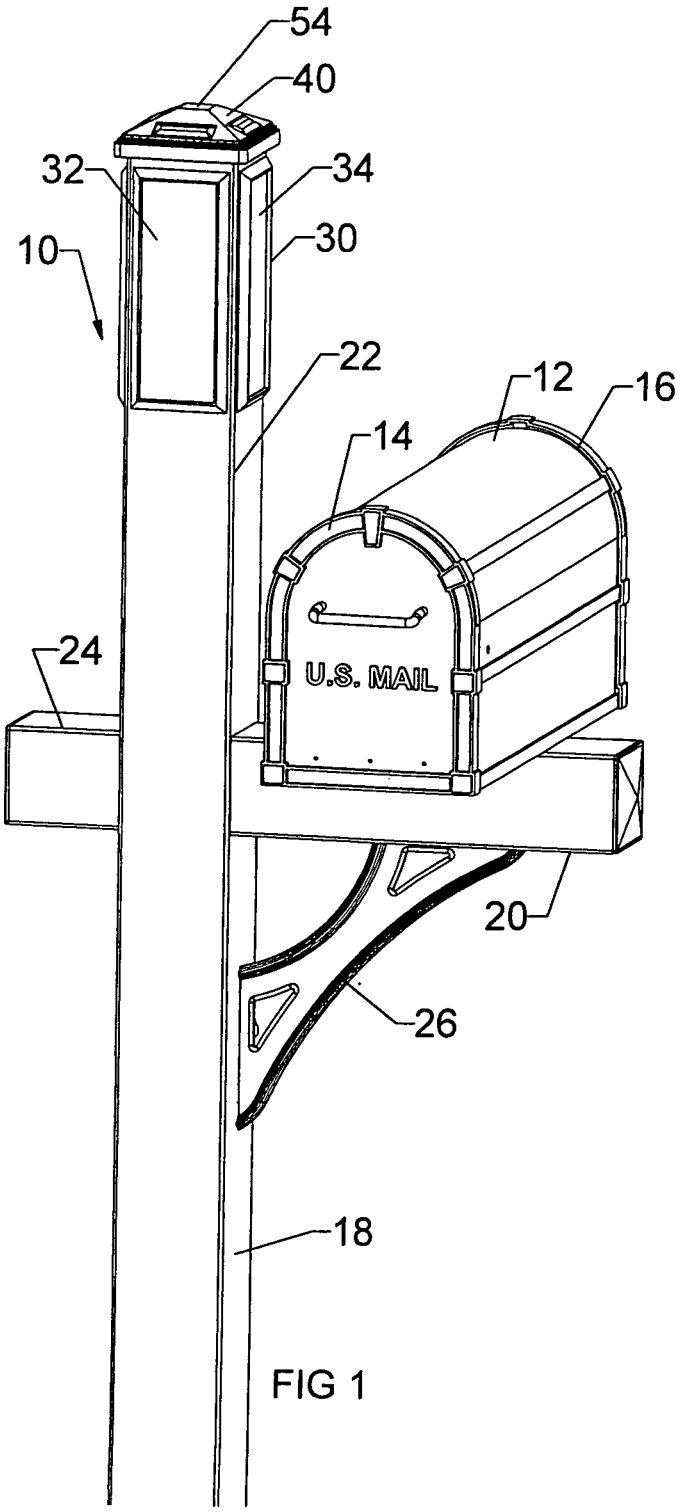
FIG. 1 is a perspective view of a preferred solar powered, illuminated post assembly for supporting a mailbox in accordance with this invention.
Figure 2:
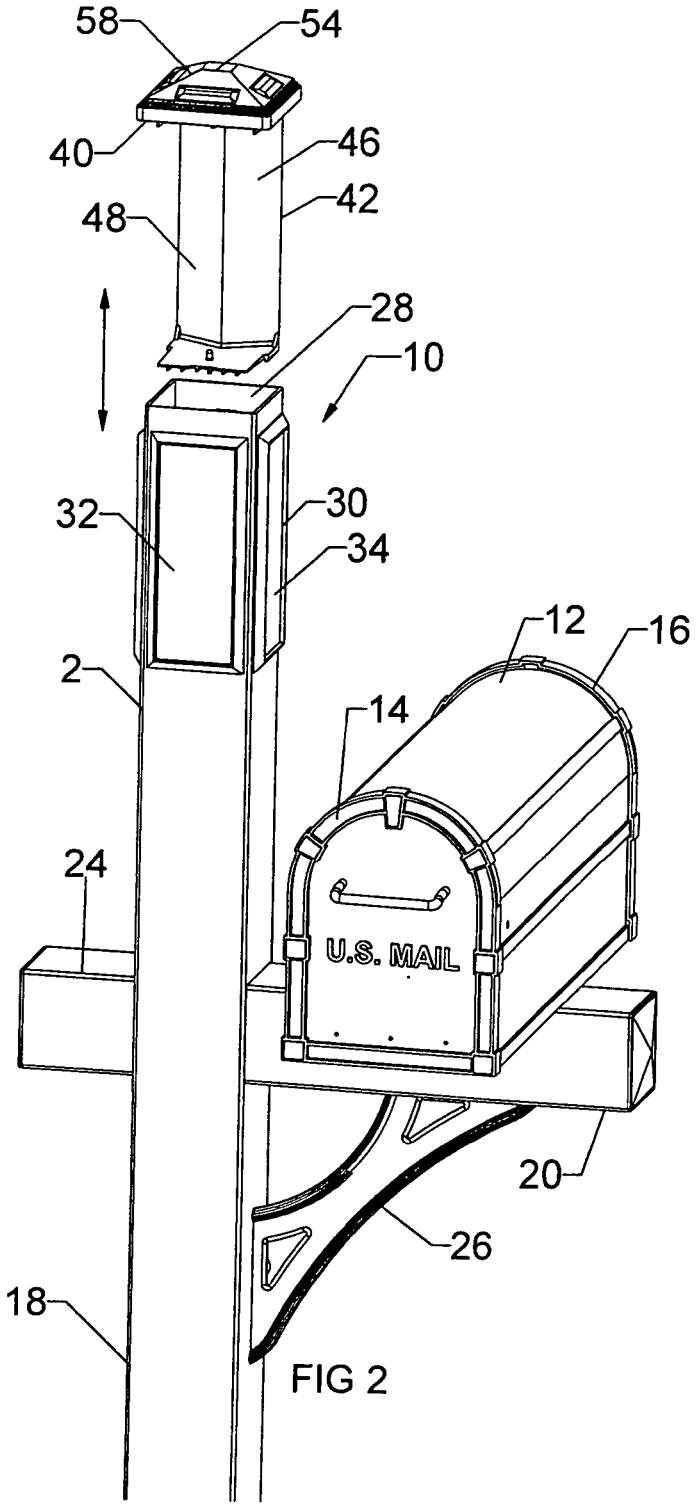
FIG. 2 is a front, exploded perspective view of the assembly with the light unit removed from the vertical support post.
Figure 3:
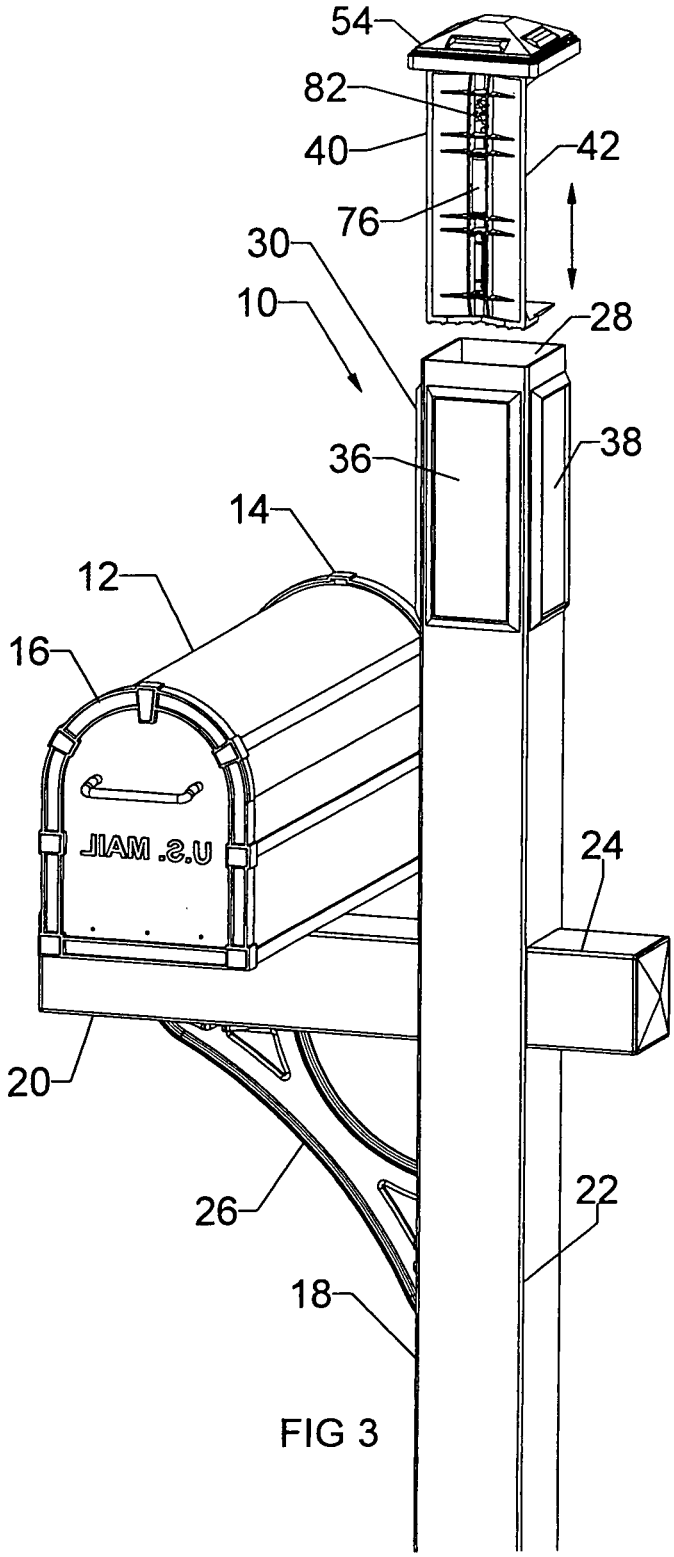
FIG. 3 is an exploded rear perspective view of the assembly.

There is shown in FIGS. 1-3 a solar powered, illuminated mailbox post assembly 10, which is designed for supporting a conventional mailbox 12. The mailbox may comprise a standard plastic or metal RFD mailbox having either one or two access doors. In the version shown in FIGS. 1-3, mailbox 12 features a front door 14 and a rear door 16, which provides access through either the forward or rearward ends, respectively, of mailbox 12. This allows a postal carrier to conveniently access the inside of the mailbox from his or her vehicle and, at the same time, permits the postal customer to open the box at opposite rearward end thereof. In alternative embodiments, various other styles and configurations of mailboxes may be utilized and supported by the post assembly 10.

The mailbox post assembly 10 itself includes an elongate vertical post section 18 that is mounted in the ground and an elongate horizontal post section 20, which is attached to and extends generally perpendicularly from post section 18. The preferred manner of assembling the post sections is described below. As used herein, "horizontal" and "vertical" refer to the general orientations of the respective post sections when they are assembled for use in supporting the mailbox 12. Typically, vertical post section 18 is mounted in a hole dug in the ground at a location appropriate for delivery mail. The post sections may vary from perfect vertical and horizontal orientations, within the scope of this invention, due to inaccuracies and deviations that occur during installation of the post assembly. Generally speaking, however, when the post assembly is installed, the vertical post section 18 extends upwardly from the ground and the horizontal post section extends transversely from the horizontal post section. As is described more fully below, the horizontal post section may extend either longitudinally toward or laterally parallel to the roadway, walkway or other surface along which the post is mounted. A preferred manner of assembling the vertical and horizontal post is described more fully below.

Post sections 18 and 20 typically feature a rugged and durable material such as extruded aluminum. In alternative embodiments, the post sections may be composed of other materials such as metals, molded plastic, metal alloys, wood or wood composites.

Vertical post section 18 and horizontal post section 20 employ complementary rectangular cross sectional configurations. The corners may include a slight bevel such as depicted at 22 for post section 18 and at 24 for post section 20. A diagonal brace 26 interconnects one side of vertical post section 18 and the bottom surface of horizontal post section 20. This diagonal brace is composed of cast aluminum or other material of the type utilized in the post sections. It is specifically interconnected between the post sections in a manner that is described more fully below. The brace section lends additional support to the horizontal post section which is holding mailbox 12.

As best shown in FIGS. 2 and 3, an axial rectangular chamber 28 is formed in the upper end of vertical post section 18. Chamber 28 typically extends longitudinally through the entire length of post section 18. In alternative embodiments, the chamber extends to at least the bottom of a window assembly 30 carried by post section 18 proximate the upper end of the vertical post section. Window assembly 30 features four window segments 32, 34, 36 and 38 that are carried by respective sides of vertical post section 18. At least some of the window segments carry street numbers or other indicia, which are highlighted in accordance with this invention, in a manner described below. The window segments are likewise described in greater detail below.

Figure 4:
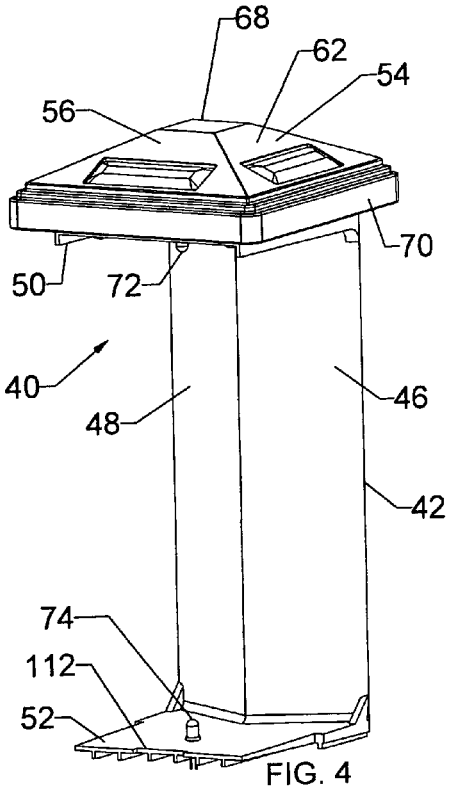
FIG. 4 is a front perspective view of the light unit.
Figure 5:
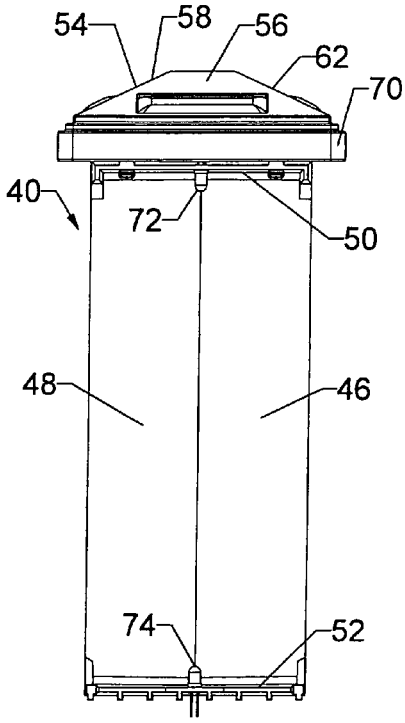
FIG. 5 is a front elevational view of the light unit.
Figure 6:
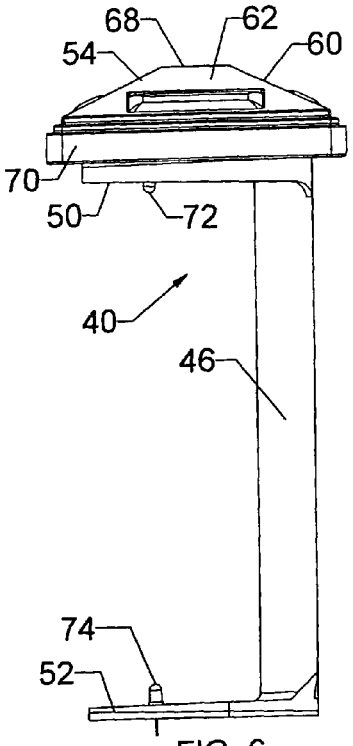
FIG. 6 is a side elevational view of the light unit.
Figure 7:
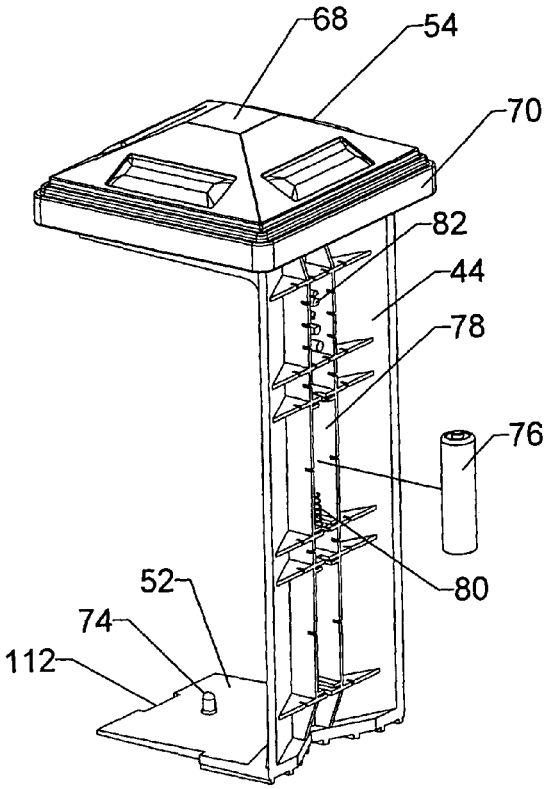
FIG. 7 is a perspective rear view of the light unit and a rechargeable battery used to energize the light unit.
Figure 8:
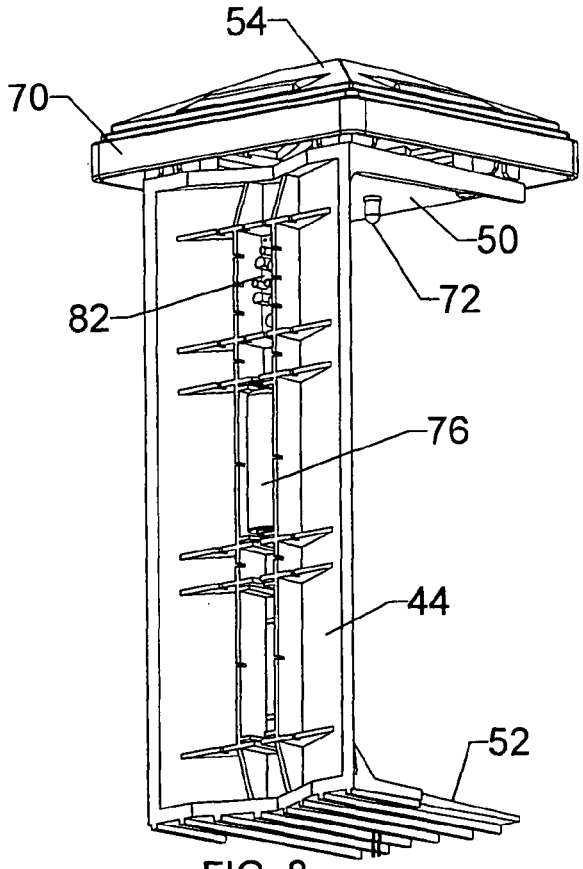
FIG. 8 is a lower perspective rear view of the light unit with the rechargeable battery installed in a battery compartment.
Figure 9:
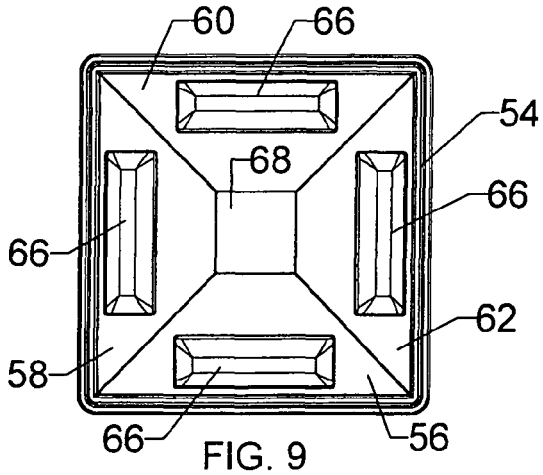
FIG. 9 is a top plan view of the light unit specifically depicting the post cap and the solar collectors mounted thereon.

A modular light unit 40 is longitudinally and removably receivable in chamber 28 of post section 18. The light unit, which is shown alone in FIGS. 4-9, includes an elongate, vertically disposable column 42, which, in turn, comprises a molded plastic framework 44, FIGS. 7 and 8 supporting a diverging pair of reflective panels or mirrors 46 and 48, FIGS. 4-6. Any type of mirrors or reflective panels suitable for use in lighting applications may be utilized. The reflective surfaces may comprise chrome mirror finishes that are applied to the underlying framework 44. Alternative forms of reflective or mirrored surfaces may be utilized.

Light unit 40 also includes a pair of spaced apart upper and lower platforms 50 and 52, which are formed respectively at the upper and lower ends of column 42. More particularly, platforms 50 and 52 are formed unitarily with plastic framework 44 when lighting unit 40 is being manufactured. Preferably, framework 44 and upper and lower platforms 50 and 52 comprise a one-piece molded plastic construction.

A preferably plastic post cap 54, FIGS. 1-9, is attached to and carried by upper platform 50. The post cap may be secured to the platform by metal screws or otherwise. For example, the cap 54 and platform 50 may include corresponding snap fasteners or other types of plastic connectors that securely and permanently fasten the post cap to the upper platform (i.e. when framework 44 and upper and lower platforms 50 and 52 are molded). Post cap 54 has a fairly shallow, truncated, pyramidal configuration including four inclined sides, which face outwardly at respective angles from the cap 54. Each inclined surface supports a respective solar collector cell 66. These cells collect solar energy to recharge the light unit in a manner that will be described more fully below. The inclined surfaces terminate in a truncated horizontal upper surface 68. A peripheral lip 70 depends from the inclined sides and hangs somewhat over the upper platform 50. This lip allows the modular light unit 40 to engage and attach to the upper end of vertical post section 18, once again, in a manner described more fully below.

As best shown in FIGS. 4-8, light unit 40 also includes a light source comprising upper and lower LEDs 72 and 74 respectively. The LEDs preferably comprise long lasting LEDs suitable for outdoor use. The LEDs are received and securely mounted in respective receptacles formed in upper and lower platforms 50 and 52. LEDs 72 and 74 are disposed proximate the vertex of diverging reflective panels 46 and 48. See particularly FIGS. 4 and 5. The LEDs are connected by appropriate wiring to a rechargeable battery 76, FIGS. 7 and 8, which is received in a battery compartment 78 formed in framework 44. The rechargeable battery may comprise a conventional nickel cadmium rechargeable battery or alternative form of standard rechargeable power supply. Conventional battery contacts are formed in the compartment. See, for example, spring contact 80 in FIG. 7.

Rechargeable battery 76 is electrically interconnected to a recharging circuit 82 comprising a printed circuit board mounted within a respective compartment of framework 44. Circuit 82 recharges battery 76 in response to solar energy collected by cells 66. The recharging circuit also operates to activate the LEDs only during period of evening hours and other periods of low outdoor ambient light.

Figure 10:
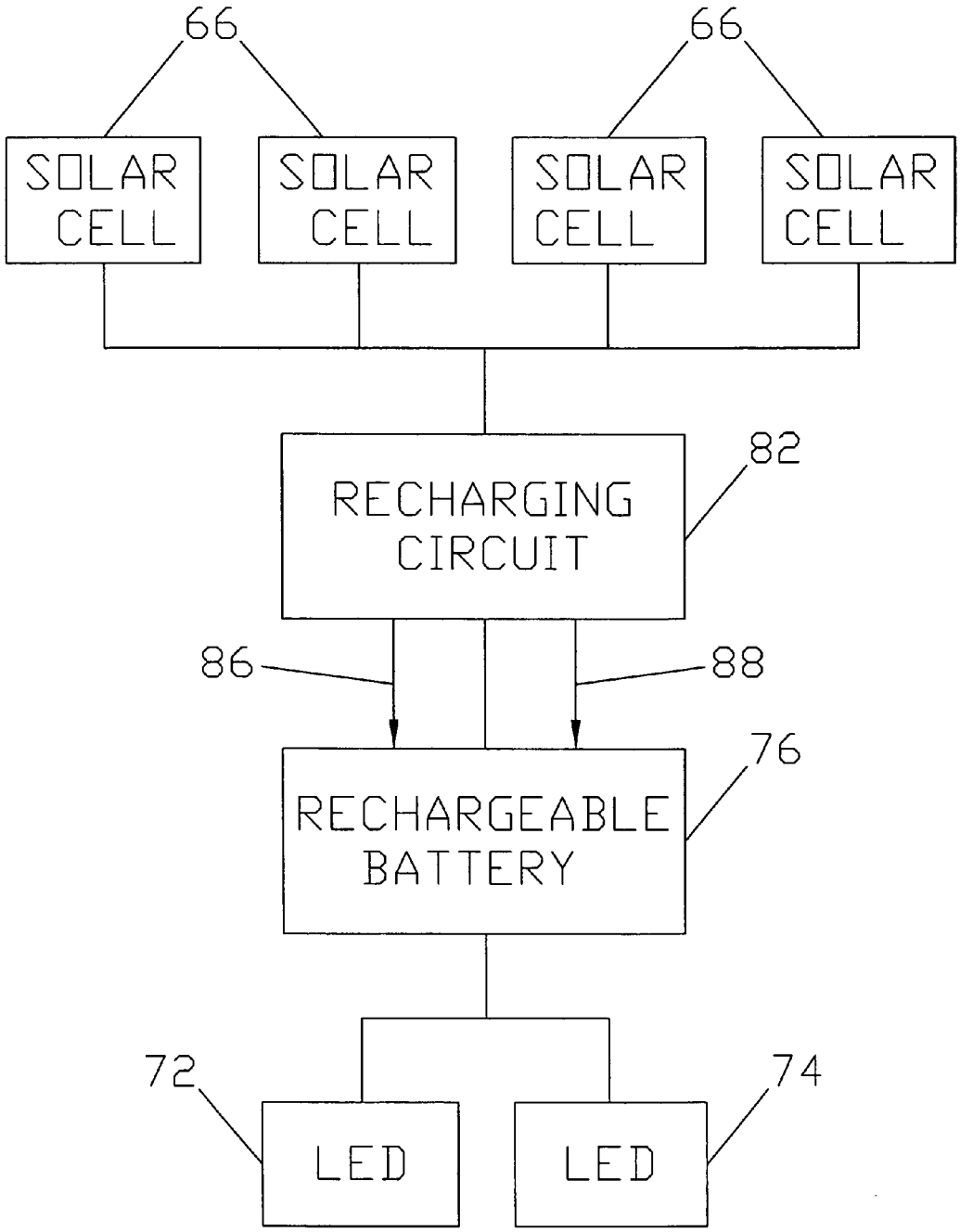
FIG. 10 is a schematic view of the electrical components of the assembly.

The electrical circuitry of light unit 42 is depicted diagrammatically in FIG. 10. As shown therein, solar cells 66 are wired to recharging circuit 82. The recharging circuit is in turn connected to rechargeable battery 76, which is wired to LEDs 72 and 74. In operation, during daylight hours, solar cells collect solar energy and convert that energy to electric power, which is delivered to recharging circuit 82. The recharging circuit includes conventional electronic components, known to persons skilled in the art, which deliver a recharging input 86 to rechargeable battery 76. The recharging circuit may also include components that deactivate the LEDs during daylight hours when LED operation is not required. For example, as the solar cells 66 deliver recharging power to circuit 82, a sensing voltage may be developed in the recharging circuit. This voltage may provide a signal 88 to recharging battery 76, which directs the battery to operatively disconnect from LEDs 72 and 74. As a result, the light unit is deactivated.

Alternatively, during evening hours or during other times of relative low light or darkness, solar cells 66 do not deliver recharging power to circuit 82. As a result, the recharging circuit does not develop a sense voltage and signal 88 is removed. This causes the rechargeable battery 76 to reconnect with LEDs 72 and 74 and to release power to the LEDs, which energizes and illuminates the light unit.

It should be understood, in alternative embodiments, various other means may be utilized to activate and deactivate the light source during periods of darkness and daylight respectively. For example, an optical sensor and/or microprocessor may be utilized to activate and deactivate the lights as required. Recharging circuits of the type used for circuit 82 are known for other outdoor lighting operations and will be understood by persons skilled in the art.

Figure 11:
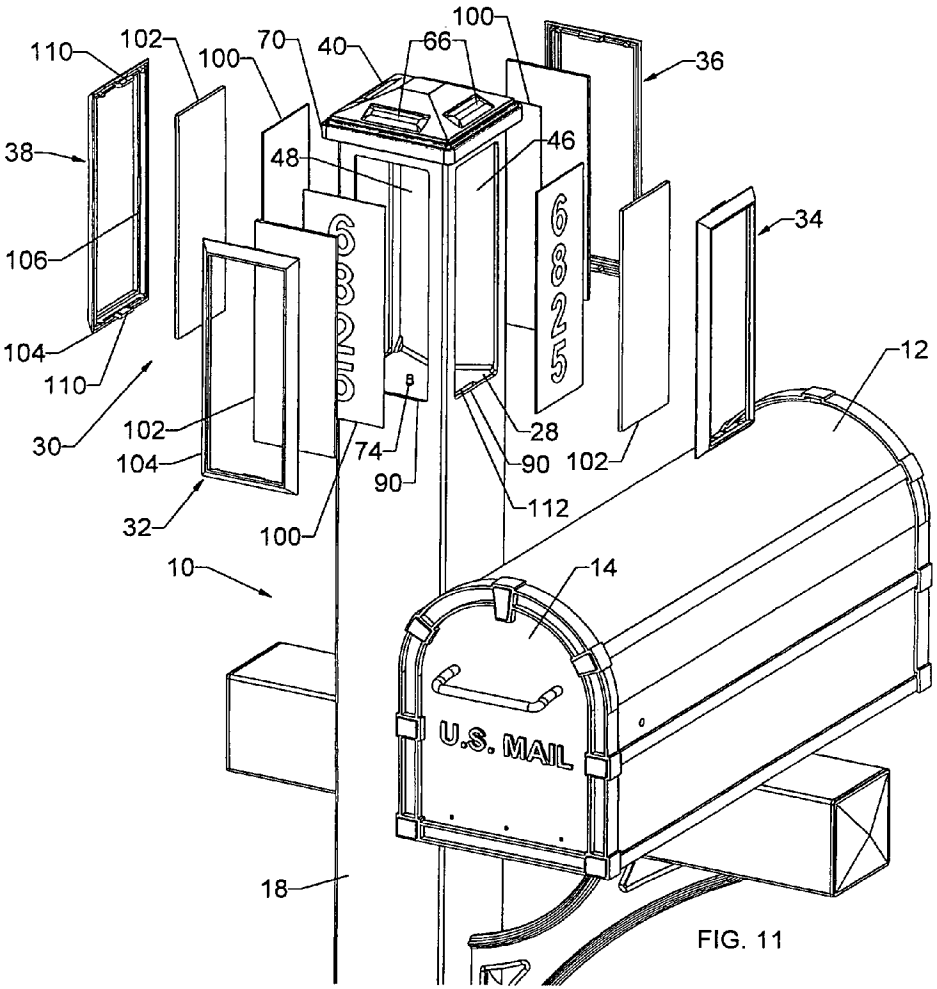
FIG. 11 is an exploded perspective view of the assembly with the indicia bearing windows depicted in exploded form adjacent to the light unit mounted in the vertical support post.

FIG. 11 depicts assembly 10 with light unit 40 installed in the chamber of post section 18 as described above. The window assembly 30 is depicted in exploded form to better illustrate the manner in which the light unit is incorporated into the chamber of post section 18. In particular, when light unit 40 is received in chamber 28, lip 70 of post cap 40 overlaps and snugly interengages the upper end of post section 18. The post cap and vertical post section have complementary rectangular cross sectional shapes so that a snug and secure overlapping fit is provided.

Each of the four sides of vertical post section 18 has a rectangular window opening 90 formed therein. Windows with indicia are mounted over only three of these openings. However, by providing a window opening in each of the four sides of the vertical post, the post may be manufactured in a modular manner that allows its orientation to be adjusted for either side mounting or front mounting of the mailbox. This is described more fully below. When light unit 40 is inserted into the upper end of vertical post section 18, the LEDs 72, 74 and the reflective panels 46 and 48 are positioned so that, when activated, the light unit projects light outwardly through three of the window openings 90. When the light unit is mounted in the vertical post section, it is positioned adjacent to the window openings and reflective panels 46,48 face the three window openings through which reflected light from LEDs 72, 74 is transmitted.

In the side mounted mailbox version shown in FIGS. 1-11, the front door 14 of mailbox 12 typically faces the street along which mail deliveries are made. Accordingly, window segment 32 faces the street and window segments 34 and 38 point in respective directions that are generally parallel to the roadway. These are the three window segments that are the most appropriate for displaying street numbers or other pertinent identifying information. As a guest, delivery person, policeman or emergency worker approaches the mailbox, he or she will almost certainly approach it such that one or more of windows 32, 34, 38 are visible from the street or roadway. These are the windows that should bear the identifying indicia.

In particular, each of the indicia bearing window segments 32, 34 and 38 includes a transparent interior panel 100 that is preferably composed of plastic or extremely durable glass material. Information that identifies the residence or address associated with the mailbox, i.e. "6825" representing the street number, is applied to each panel 100. The indicia may be opaque and may comprise, for example, black vinyl tape or other forms of appliqués or stickers, painting, etching, etc., which are relatively opaque or otherwise block the transmission of light. An outer diffuser panel 102 is disposed over indicia bearing panel 100. The diffuser panel scatters the transmitted light and further highlights the opaque indicia.

A plastic frame 104 is disposed about the juxtaposed panels 100 and 102 and supports those panels in a respective window opening 90. In particular, frame 104 includes an interior recess 106 having dimensions that snugly receive the juxtaposed panels 100 and 102. Each peripheral frame 106 has integral upper and lower tabs 110 that are snap fit into window openings 90.

After light unit 40 is inserted into the upper end of vertical post section 18 and is positioned as shown in FIG. 11, the respective window segments may be quickly and conveniently attached to their corresponding window openings 90 in the vertical post section. In particular, the underlying indicia panel 100 and overlying diffuser panel 102 are juxtaposed against one another and inserted into the nesting recess 106 of frame 104. The window assembly is then attached to the vertical post section by snap fitting frame 104 into the opening in the above described manner. The window segments may be attached and removed quickly, conveniently and without requiring any tools or separate fasteners.

As shown in FIG. 11, a fourth window segment 36 is secured to the side of the post facing away from the street or roadway. Typically, it is unnecessary to display illuminated indicia along this side of the mailbox support post. Nonetheless, because the post employs a modular construction with an opening along each side, it is usually desirable for aesthetics and to prevent undesirable water intrusion into the post to form a window over the fourth opening. Accordingly, the window segment 36 having a structure analogous to the other window segments is attached. The only difference with this window segment is that the interior 100 typically does not carry a street number or other site specific identifying information. Instead, the interior panel may carry a manufacturer's logo or other information. In certain versions, a totally opaque interior panel may be used for window segment 36 in as much as window segment 36 does not face the reflective surfaces 46, 48 and light is not transmitted through that window from light unit 40.

Figure 12:
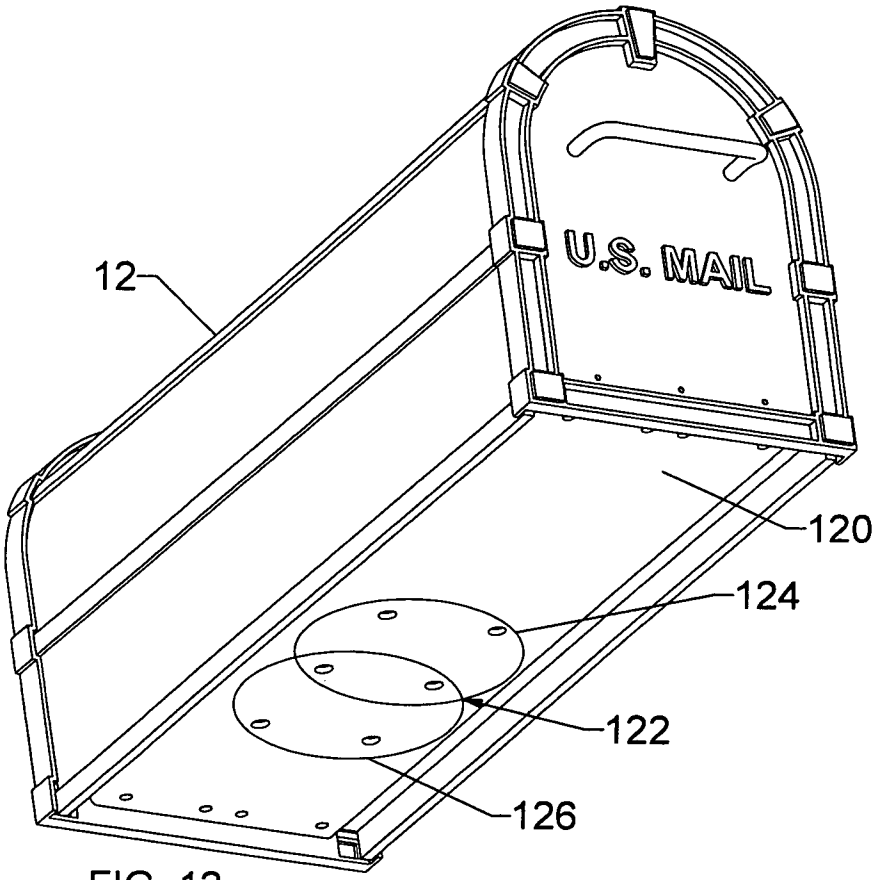
FIG. 12 is a lower perspective view of a representative mailbox supported by the assembly of this invention; upper connector holes formed in the bottom of the mailbox are specifically depicted.

As shown in FIGS. 12-19, mailbox assembly 10 further includes a modular construction that permits mailbox 12 to be mounted either to the side or forwardly of vertical post section 18. As shown in FIG. 12, a bottom surface 120 of mailbox 12 is provided with a series of six connector holes 122. A first group of these holes 124 is used to mount mailbox 12 laterally upon horizontal post section 20 to one side of the vertical post section, as shown in FIGS. 1-11. A second group of the holes 126 is utilized for mounting the mailbox longitudinally on post section 20 and forwardly of the vertical support post.

Figure 13:
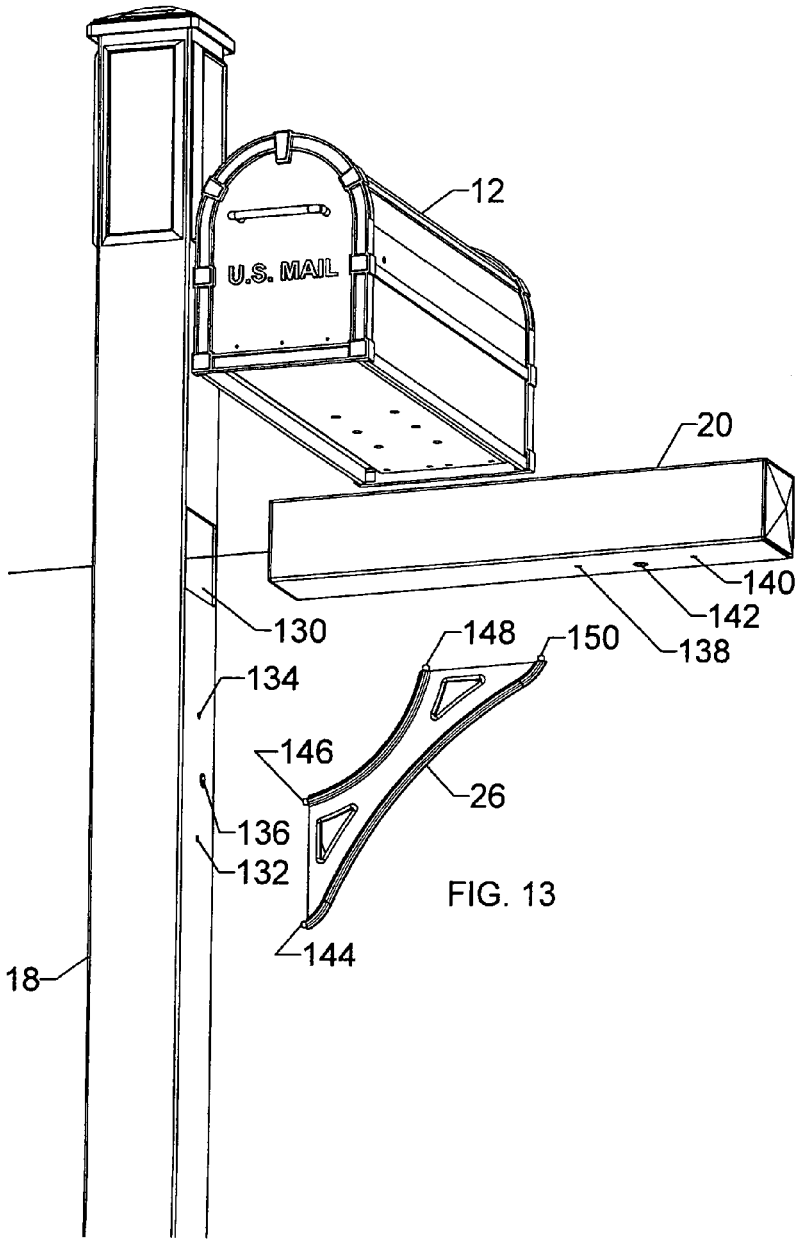
FIG. 13 is a lower perspective, partially exploded view of the assembly arranged to specifically support the mailbox laterally on one side of the post.

As shown in FIG. 13, vertical support post includes a lateral rectangular opening 130 that extends through a pair of opposing sides of the vertical post section (only one of the sides is shown in FIG. 13). Opening 130 is shaped and sized to closely conform to the rectangular cross sectional shape of horizontal post section 20. The horizontal post section is received snugly and securely by opening 130. See FIGS. 14 and 15. The complementary rectangular shapes of the horizontal post section and receptacle 130 prevent the horizontal post section from rotating or becoming accidentally dislodged. An extremely strong and secure interconnection is provided. At the same time, no tools or fasteners are required to join the horizontal post section to the vertical post section.

Figure 16:
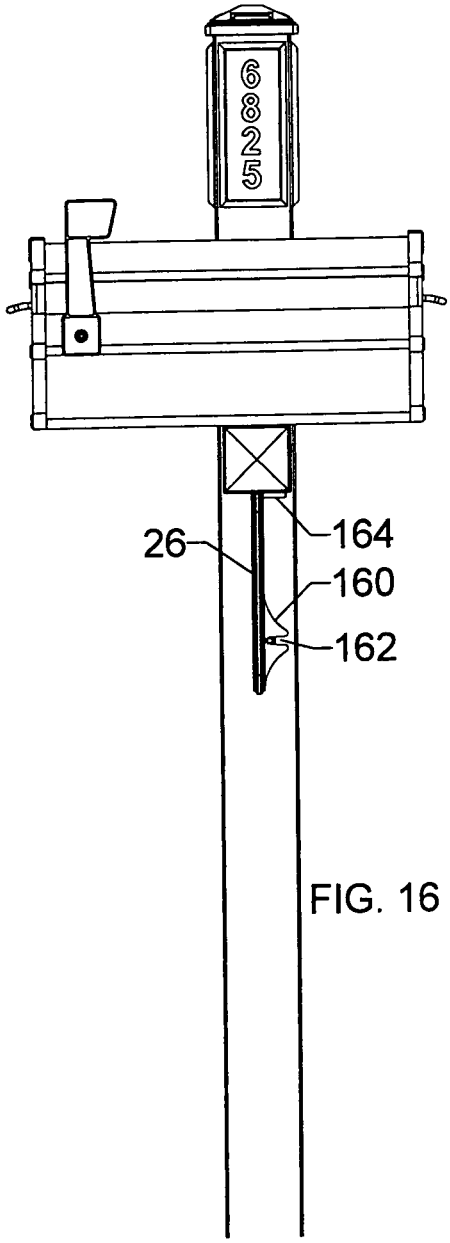
FIG. 16 is an elevational side view of a two door mailbox mounted laterally to the horizontal support post on one side of the vertical support post.

Vertical post section 18 also includes a pair of spaced apart pin receptacles 132 and 134 that are formed in one of the sides of post section 18 through which opening 130 is formed. A connector hole 136 is also formed in that side of the post section. The connector hole is located intermediate receptacles 132 and 134 and is spaced apart slightly from a line connecting those receptacles. A similar pattern of spaced apart pin receptacles 138, 140 and an intermediate connector hole 142 are formed in a bottom side of horizontal post section 20. These receptacles and connector holes are formed to permit diagonal brace 26 to be interconnected between the assembled vertical and horizontal post sections. The diagonal brace itself includes a pair of pins 144 and 146 formed at one end thereof and a second pair of pins 148 and 150 carried by the opposite end thereof. As shown in FIG. 16, brace 26 also includes an integral flange 160 having a recess 162. A similar flange 164 is carried along an upper end of brace 26.

To interconnect brace 26 between the vertical and horizontal post sections, pins 144 and 146 of the brace are inserted into pin receptacles 132 and 134 respectively in post section 18. This also aligns the slot 162, FIG. 16, of flange 160 with connector hole 136 in post section 18. At the opposite, upper end of brace 26, pins 148 and 150 are inserted into pin receptacles 138 and 140 in post section 20. The obscured, but analogous slot formed in flange 164 is likewise aligned with connector hole 142. Appropriate screws or bolts are interengaged with aligned slot 162 and connector hole 136. A similar screw or bolt is interengaged with the slot in the upper flange and its aligned connector hole 142. The brace is thereby securely interconnected between the vertical and horizontal post sections. This reinforces the overall strength and durability of the mailbox post assembly.

Figure 14:
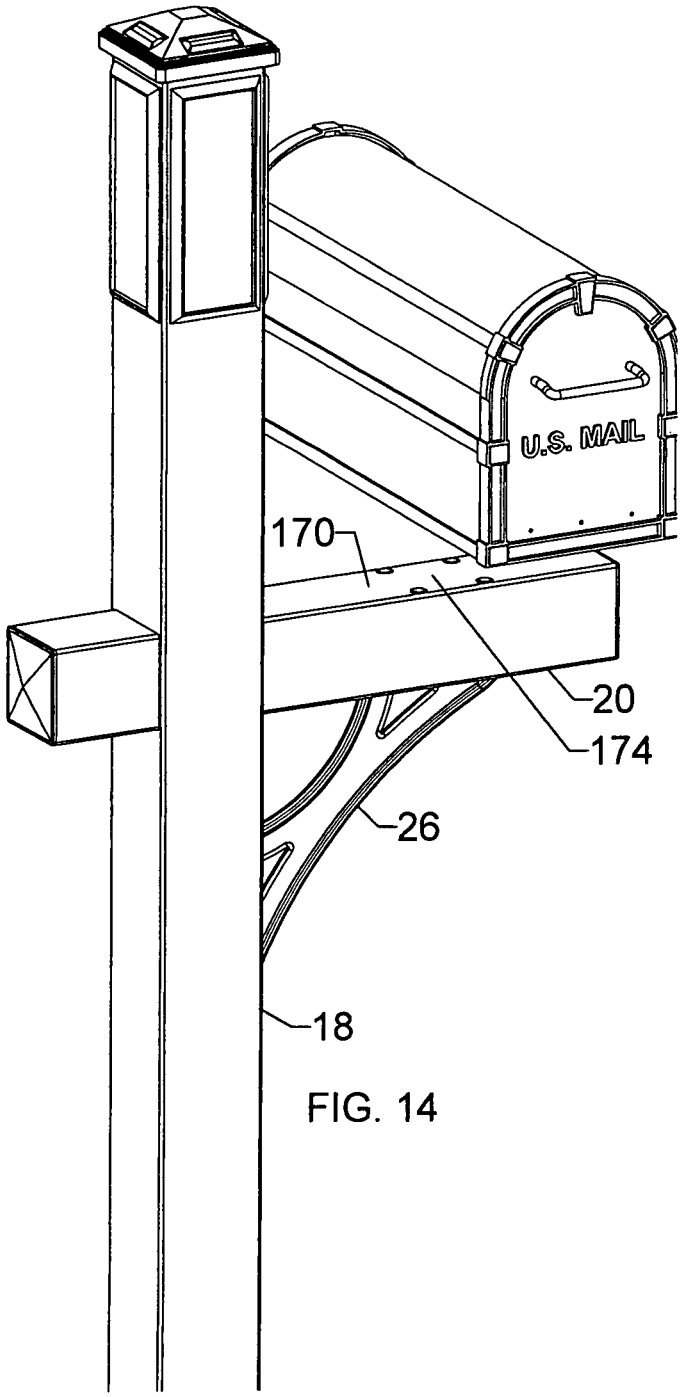
FIG. 14 is an upper perspective view of the side mounted version specifically depicting the lower connector holes formed in the horizontal support post.
Figure 15:
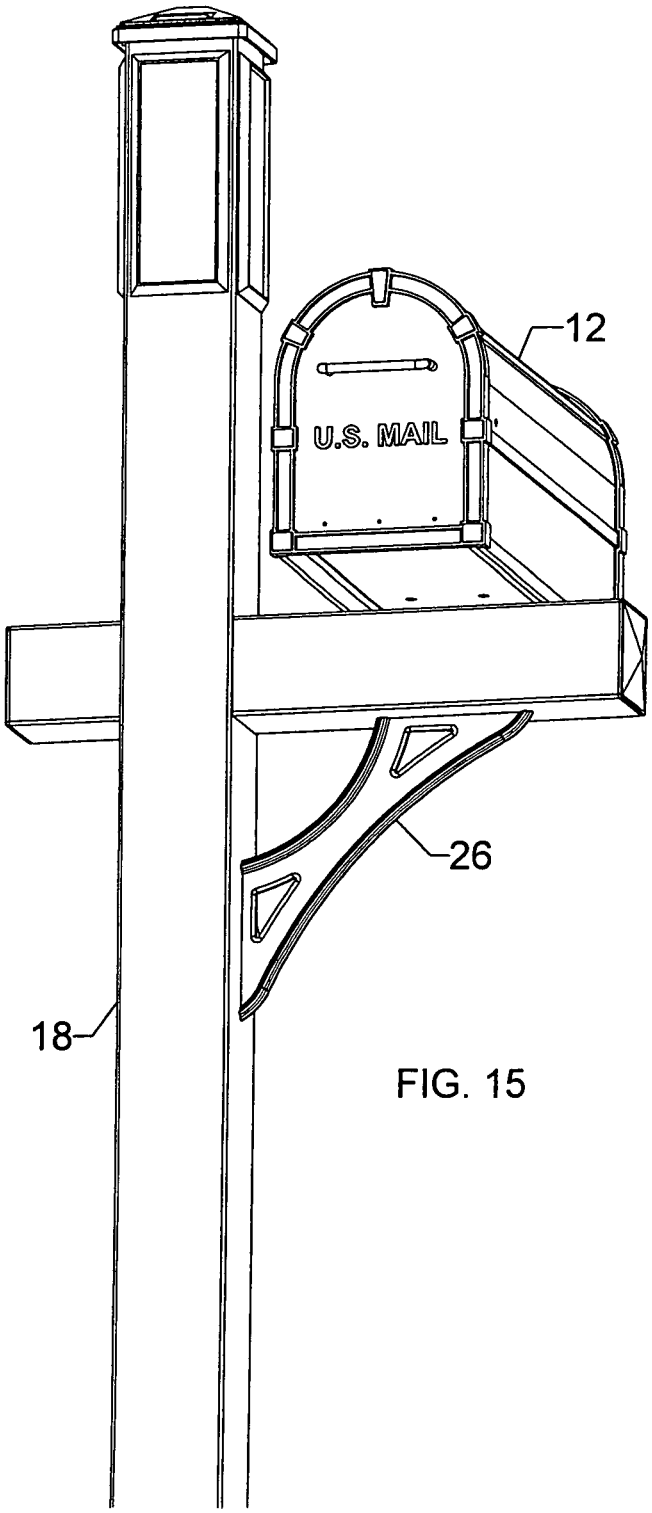
FIG. 15 is a lower perspective view of a mailbox mounted laterally on the horizontal support post and on one side of the vertical support post.

After the post is fully assembled, the mailbox is attached to horizontal post section 20. In particular, as shown in FIG. 14, an upper side surface 170 of post section 20 includes a rectangular array of connector holes 174. These holes are aligned with a forward pattern of holes 124, FIG. 12, formed in the bottom of mailbox 12. Holes 174 are aligned with holes 124 and screw or bolt connectors, not shown, are formed through the aligned holes to secure the mailbox to the post. See FIGS. 1, 15 and 16.

Figure 17:
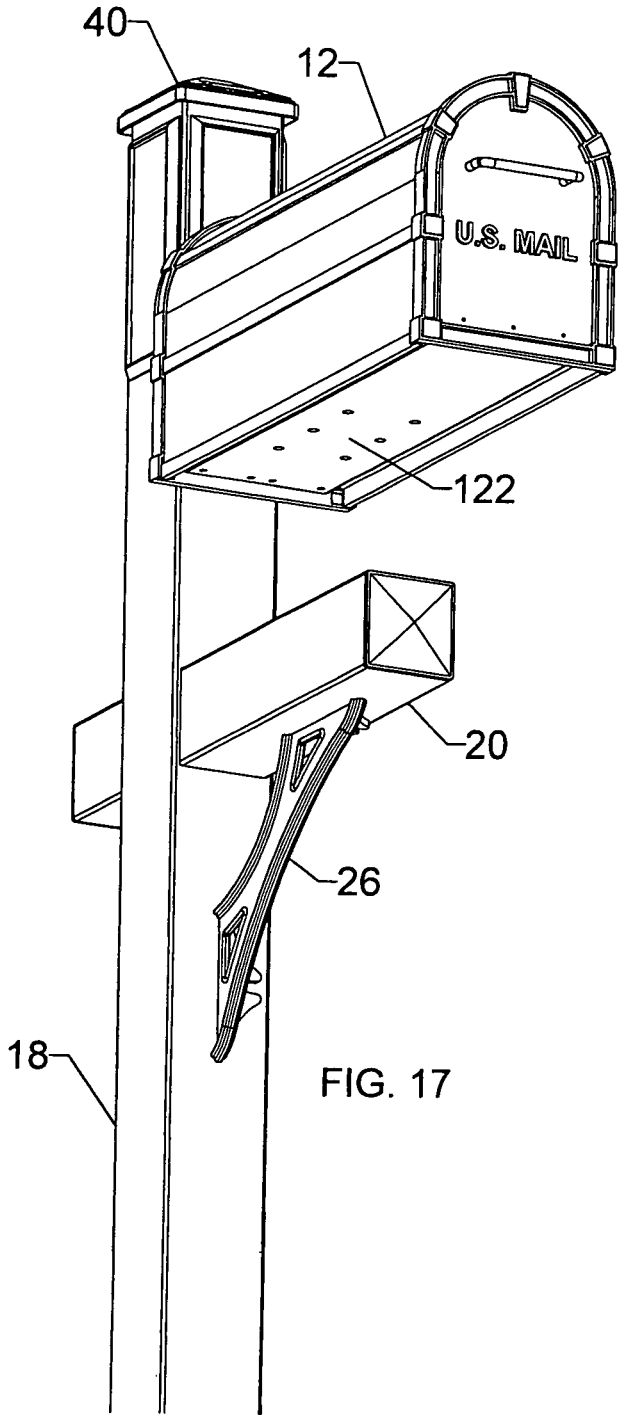
FIG. 17 is a lower perspective, partially exploded view of a mailbox mounted longitudinally on the horizontal support post and forwardly of the vertical support post.
Figure 18:
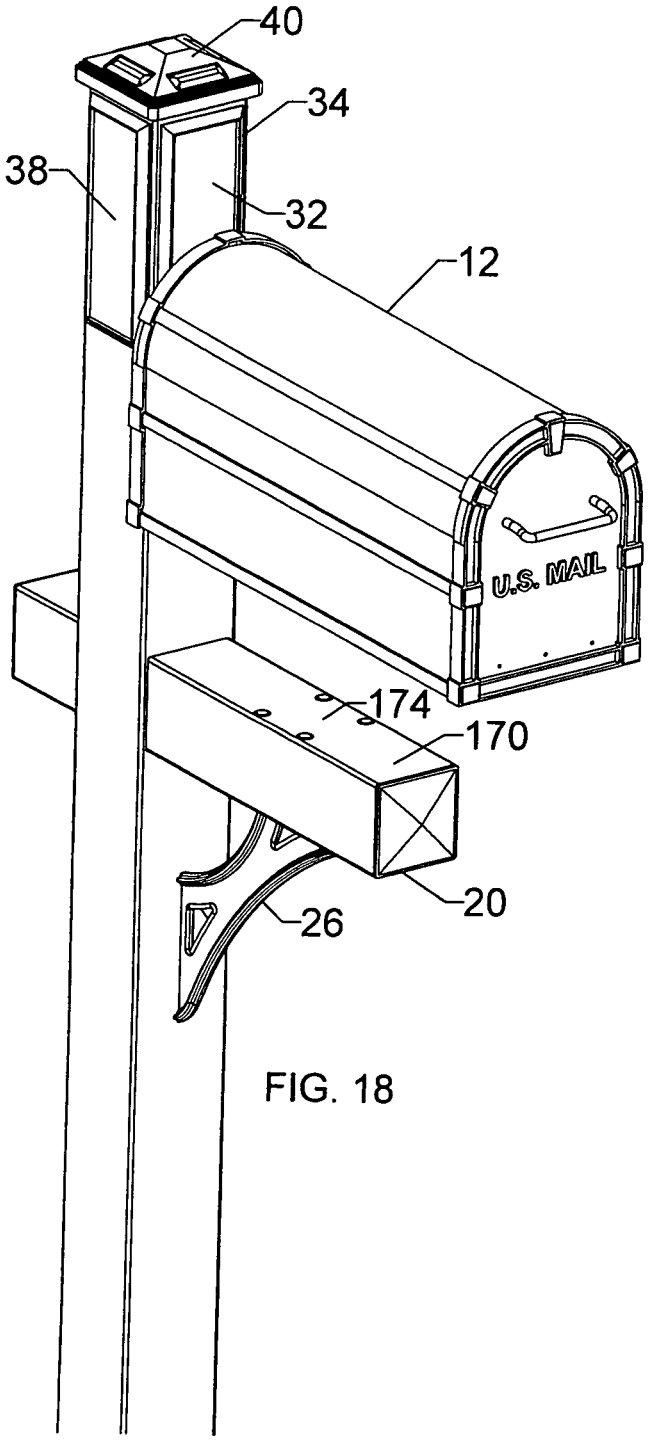
FIG. 18 is an upper perspective, partially exploded view of the embodiment depicted in FIG. 17 and specifically illustrating the lower connector holes formed in the horizontal support post.
Figure 19:
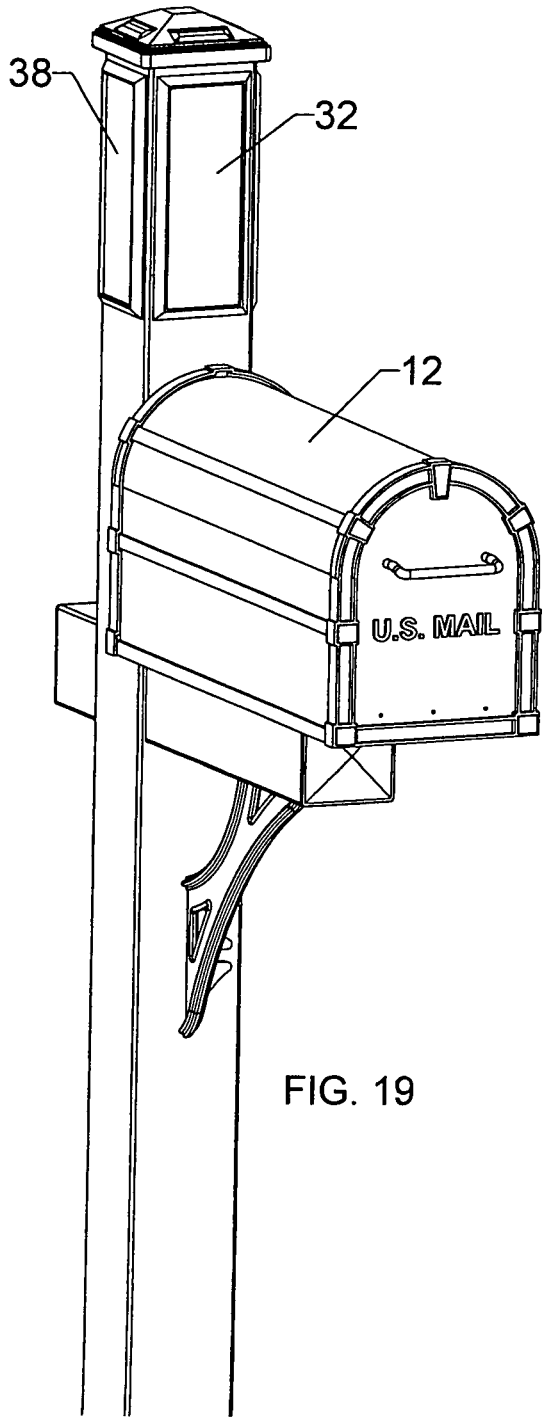
FIG. 19 is a perspective view of the fully assembly support post and mailbox in accordance with the embodiment shown in FIGS. 17 and 18.

Front mounting of mailbox 12 is depicted in FIGS. 17-19. The individual components of modular assembly 10, i.e. the vertical and horizontal post sections 18 and 20, diagonal brace 26 and light unit 40 are constructed in a manner identical to that of the previously described embodiment. The only differences featured by the front mounted mailbox post assembly are the orientation of the vertical post section relative to the roadway, the 90° re-orientation of the light unit in the chamber and the longitudinal, rather than lateral mounting of the mailbox on the horizontal post section. Before the post is fully assembled, vertical post section 18 is installed with its previously described opening 130 now facing the street or walkway (i.e. facing forwardly) rather than to the side as in the prior embodiment. The horizontal post section 20 and the diagonal brace 26 are then attached as previously described. See FIGS. 17 and 18. Once again, lower connector holes 174 are formed in the upper surface 170 of post section 20. Light unit 40 is then inserted into the chamber of the vertical post section, as previously described, with its window segments 32, 34 and 38 oriented to be illuminated along appropriate sides of the vertical post section as depicted in FIGS. 17-19. Mailbox 12 is aligned with post 20 and positioned thereon such that the rearward group 126 of connector holes 122 in mailbox 12 are aligned with lower connector holes 174 in horizontal post section 20. The mailbox is opened and appropriate screws or bolts are interengaged with the aligned holes to secure the mailbox to the horizontal post, see FIG. 19. Once again, a secure mailbox post structure is provided and the mailbox is securely and reliably mounted upon the post. The front mounted orientation is most effective for holding the door of the mailbox outwardly as far and as close to the road as possible. Nonetheless, the vertical post blocks access through a rear door of box 12 (i.e. door 16 in FIG. 13). The side mounted version is particularly effective when double sided mailbox doors are to be utilized. In such cases, the vertical post section does not interfere with opening the inside door (i.e. the door most conveniently accessed by the postal customer).

In operation, post assembly 10 is oriented and assembled in the foregoing manner to provide for either side mounting, FIGS. 1-11 and 13-16 or front mounting, FIGS. 17-19 of mailbox 12. The modular construction of the post sections, the brace and the light unit allow either version to be constructed quickly and conveniently without requiring extraneous tools or attachments. The conforming shapes used by the vertical post section and a light unit allow the light unit to be manually positioned in and attached to the vertical post in a quick, a convenient and secure fashion, again without requiring various connectors or tools.

Either version of the mailbox post assembly operates reliably to provide lighted residence information while requiring very little maintenance and repair. During daylight hours, the solar cells 66 collect sunlight and convert that energy to electrical power. The solar collector cells are positioned in an efficient and beneficial manner on four opposing inclined surfaces of the post cap. This allows solar energy to be collected effectively regardless of the orientation or location of the post assembly or the position of the sun in the daytime sky. The solar collector cells are positioned so that some light is effectively captured at virtually all daylight hours of the day.

As previously indicated, the solar collector cells deliver electrical power to the recharging unit. During daylight hours, this circuit continuously recharges battery 76. At the same time, the recharging circuit operatively disconnects the battery from the LEDs so that the LEDs are not inefficiently and unnecessarily illuminated during such daylight hours. At night or during other periods when a predetermined level of darkness is reached, the recharging circuit directs the battery to operatively connect to the LEDs. Power from the battery energizes the LEDs, which emit light. This light is reflected from mirror panels 46 and 48 and that reflected light is transmitted through window segments 32, 34 and 38. The opaque identifying indicia are highlighted. Easy to see and reliable identifying information is thereby carried on the mailbox post. Guests, delivery persons and/or emergency personnel are able to locate a particular address quickly and reliably.

It should also be understood that the indicia may comprise apartment numbers, names and various other alpha/numeric or symbolic designations. The indicia may be carried by the window in assorted ways other than those specifically disclosed in the drawings. For example, the windows may be cut out or otherwise formed in the shape of the particular indicia and light may be transmitted through such shapes to relay the identifying information. Various other forms of opaque, translucent and/or transparent indicia may be utilized and display.

The assembly of this invention uses electrical components, including solar collectors, recharging circuit, LEDs and mirrored reflectors that provide significant advantages over the prior art. The post assembly does not require the use of AC wiring, which is difficult and expensive to install and which is subject to malfunctioning particularly under adverse weather conditions. Instead, the assembly of the present invention is able to operate for extremely long period of time requiring little, if any, maintenance. When repair or maintenance are eventually required, these can be performed quickly, conveniently and cost effectively. The light unit, as well as the window segments, are totally modular so that they can be removed and replaced quite expeditiously and without requiring extra tools or significant physical effort.

It is particularly advantageous that the lighted address or other indicia be visible from three sides of the mailbox and not simply a pair of sides. This allows persons attempting to locate the address with much better visibility and guidance.

From the foregoing it may be seen that the apparatus of this invention provides for an illuminated mailbox post assembly and, more particularly, to a modular mailbox mounting post equipped with a light source energized by a solar rechargeable battery. While this detailed description has set forth particularly preferred embodiments of the apparatus of this invention, numerous modifications and variations of the structure of this invention, all within the scope of the invention, will readily occur to those skilled in the art. Accordingly, it is understood that this description is illustrative only of the principles of the invention and is not limitative thereof.

Although specific features of the invention are shown in some of the drawings and not others, this is for convenience only, as each feature may be combined with any and all of the other features in accordance with this invention.

Other embodiments will occur to those skilled in the art and are within the following claims:

What is claimed is:

1. A solar powered, illuminated mailbox post assembly comprising:

a support post structure for supporting a mailbox operatively thereon, said support post structure including a vertical post section for mounting in the ground and extending upwardly therefrom, said vertical post section having an interior chamber;

a light unit disposed in said chamber and including a light source and a rechargeable power supply operatively connected to said light source for energizing said light source and causing said light source to illuminate, said light source including at least one LED;

at least one solar collector operably connected to said rechargeable power supply for collecting solar energy and converting such solar energy to electric power that is directed to said power supply for recharging thereof; and at least one window formed in said vertical post section adjacent said chamber and including indicia that are highlighted for display when said light is illuminated and light is transmitted through said window, said light unit including a reflector for directing light from said LED through said window, said reflector including a pair of diverging panels, each including a mirror surface from which light from said light source is reflected.

2. A solar powered, illuminated mailbox post assembly comprising:

a support post structure for supporting a mailbox operatively thereon, said support post structure including a vertical post section for mounting in the ground and extending upwardly therefrom, said vertical post section having an interior chamber;

a light unit disposed in said chamber and including a light source and a rechargeable power supply operatively connected to said light source for energizing said light source and causing said light source to illuminate, said light source including at least one LED;

at least one solar collector operably connected to said rechargeable power supply for collecting solar energy and converting such solar energy to electric power that is directed to said power supply for recharging thereof; and at least one window formed in said vertical post section adjacent said chamber and including indicia that are highlighted for display when said light is illuminated and light is transmitted through said window, said light unit including a reflector for directing light from said LED through said window, said light unit further including a generally vertical column for supporting said reflector and generally horizontal upper and lower platforms attached to and extending transversely from opposite end portions of said column, at least one of said platforms carrying said light source thereon.

3. A solar powered, illuminated mailbox post assembly comprising:

a support post structure for supporting a mailbox operatively thereon, said support post structure including a vertical post section for mounting in the ground and extending upwardly therefrom, said vertical post section having an interior chamber;

a light unit disposed in said chamber and including a light source and a rechargeable power supply operatively connected to said light source for energizing said light source and causing said light source to illuminate, said light unit comprising a modular unit longitudinally and removably receivable by said chamber of said vertical post section, said chamber being formed longitudinally through at least an upper end region of said vertical post section, said light unit being enclosed within said chamber and protected therein against wet and otherwise inclement weather conditions;

a post cap attached to said light unit and being engaged with an upper end of said vertical post section to cover said chamber when said light unit is received by said chamber;

at least one solar collector operably connected to said rechargeable power supply for collecting solar energy and converting such solar energy to electric power that is directed to said power supply for recharging thereof; and at least one window formed in said vertical post section adjacent said chamber and including indicia that are highlighted for display when said light is illuminated and light is transmitted through said window.

4. The assembly of claim 3 in which said solar collector is mounted on said post cap.

5. The assembly of claim 3 in which said post cap has a plurality of includes surfaces facing different respective directions, and wherein said solar collector includes multiple solar collection elements, each said solar collection element being disposed on a respective inclined surface of said post cap.

6. A solar powered, illuminated mailbox post assembly comprising:

a support post structure for supporting a mailbox operatively thereon, said support post structure including a vertical post section for mounting in the ground and extending upwardly therefrom, said vertical post section having an interior chamber;

a light unit disposed in said chamber and including a light source and a rechargeable power supply operatively connected to said light source for energizing said light source and causing said light source to illuminate, said light unit comprising a modular unit longitudinally and removably receivable by said chamber and said vertical post section, said chamber being formed longitudinally through at least an upper end post region of said vertical post section, said light unit being enclosed within said chamber and protected therein against wet and otherwise inclement weather conditions;

at least one solar collector operably connected to said rechargeable power supply for collecting solar energy and converting such solar energy to electric power that is directed to said power supply for recharging thereof; and at least one window formed in said vertical post section adjacent said chamber and including indicia that are highlighted for display when said light is illuminated and light is transmitted through said window, said light unit further including a reflector for reflecting light from said light source through said window, said light unit further including a generally vertical column for supporting said reflector and generally horizontal upper and lower platforms attached to and extending transversely from opposite end portions of said column, at least one of said platforms carrying said light source thereon.

7. A solar powered, illuminated mailbox post assembly comprising:

a support post structure for supporting a mailbox operatively thereon, said support post structure including a vertical post section for mounting in the ground and extending upwardly therefrom, said vertical post section having an interior chamber;

a light unit disposed in said chamber and including a light source and a rechargeable power supply operatively connected to said light source for energizing said light source and causing said light source to illuminate;

at least one solar collector operably connected to said rechargeable power supply for collecting solar energy and converting such solar energy to electric power that is directed to said power supply for recharging thereof; and at least one window formed in said vertical post section adjacent said chamber and including indicia that are highlighted for display when said light is illuminated and light is transmitted through said window, at least one said window including a first panel that carries said indicia and is disposable over corresponding window opening in said vertical post section, a second transparent panel for interposing over said first panel and a peripheral frame disposable over and surrounding said first and second panels, said light unit and said frame having complementary snap fastener elements for releasably securing said window to said vertical post section with said light unit disposed in said chamber.

8. A solar powered, illuminated mailbox post assembly comprising:

a support post structure for supporting a mailbox operatively thereon, said support post structure including a vertical post section for mounting in the ground and extending upwardly therefrom, said vertical post section having an interior chamber, said support post structure further including a horizontal post section attached to said vertical post section and extending transversely therefrom for holding the mailbox thereon;

a light unit disposed in said chamber and including a light source and a rechargeable power supply operatively connected to said light source for energizing said light source and causing said light source to illuminate;

at least one solar collector operably connected to said rechargeable power supply for collecting solar energy and converting such solar energy to electric power that is directed to said power supply for recharging thereof; and at least one window formed in said vertical post section adjacent said chamber and including indicia that are highlighted for display when said light is illuminated and light is transmitted through said window, said horizontal post section including a series of lower connector holes for being operatively aligned in a first pattern with a series of upper connector holes formed in the mailbox when the mailbox is oriented to extend laterally across said horizontal post section and for being operatively aligned in a second pattern with the upper connector holes when the mailbox is oriented to extend longitudinally on said horizontal post section, whereby fastening components are interengaged with the operatively aligned upper and lower connector holes to secure the mailbox to said horizontal post section.

9. The assembly of claim 8 in which said light source includes at least one LED.

10. The assembly of claim 9 in which said light unit includes a reflector for directing light from said LED through at least one said window.

11. A mailbox and solar powered, illuminated support post assembly comprising:

A mailbox;

a support post structure for supporting said mailbox operatively thereon, said support post structure including a vertical post section for mounting in the ground and extending upwardly therefrom, said vertical post section having in interior chamber, said vertical post section having a substantially rectangular cross sectional shape at least surrounding said interior chamber;

a light unit disposed in said chamber and including a light source and a rechargeable power supply operatively connected to said light source for energizing said light source and causing said light source to illuminate;

at least one solar collector operably connected to said rechargeable power supply for collecting solar energy and converting such solar energy to electric power that is directed to said power supply for recharging thereof; and at least one window formed in said vertical post section adjacent said chamber and including indicia that are highlighted for display when said light is illuminated and light is transmitted through said window, said vertical post section being installable to extend upwardly from the ground and adjacent to a roadway with a first side of said vertical post section facing and aligned generally parallel to the roadway and two adjoining sides of said vertical post section extending laterally from and generally perpendicular to the roadway, at least one said window including a first panel that carries said indicia and is disposable over a corresponding window opening in said vertical post section, a second transparent panel for interposing over said first panel and a peripheral frame disposable over and surrounding said first and second panels, said light unit and said frame having complementary snap fastener elements for releasably securing said window segment to said vertical post section with said light unit disposed in said chamber.

12. The assembly of claim 11 in which said interior chamber is formed longitudinally through at least an upper end region of said vertical post section and in which said light unit comprises a modular unit longitudinally and removably receivable by said interior chamber of said vertical post section, said light unit being enclosed within said interior chamber and protected therein against wet and otherwise inclement weather conditions.

13. The assembly of claim 12 in which said rechargeable power supply includes a rechargeable battery for operatively connecting to said light source and a recharging circuit interconnected between said solar collector and said battery, said recharging circuit being responsive to a predetermined electrical input from said solar collector for recharging said battery and operatively disconnecting said battery from said light source such that said light source is deactivated; said recharging circuit being responsive to less than said predetermined electrical input from said solar collector for operatively connecting said battery to said light source such that said battery causes said light source to illuminate.

14. The assembly of claim 12 in which said light unit includes a reflector for reflecting light from said light source through at least one said window.

* * * * *